United States Patent [19]

Bodmer

[11] 4,417,300

[45] Nov. 22, 1983

[54] REFLECTOR FOR UNIFORMLY ILLUMINATING AN AREA, PARTICULARLY A FILM WINDOW OF A FILM OR SLIDE PROJECTOR, AND REFLECTOR LAMP

[75] Inventor: Albert Bodmer, Munich, Fed. Rep. of Germany

[73] Assignee: Patent-Treuhand-Gesellschaft für elektrische Glühlampen mbH, Munich, Fed. Rep. of Germany

[21] Appl. No.: 275,151

[22] Filed: Jun. 19, 1981

[30] Foreign Application Priority Data

Jul. 22, 1980 [DE] Fed. Rep. of Germany ..... 3027719

[51] Int. Cl.[3] ..... F21V 7/00

[52] U.S. Cl. ..... 362/304; 362/297; 362/346; 362/347; 362/348; 362/350

[58] Field of Search ..... 362/346, 347, 348, 350, 362/297, 304

[56] References Cited

U.S. PATENT DOCUMENTS 4,208,704 6/1980 Draper ..... 362/350

4,218,727 8/1980 Shemitz ..... 362/350

4,351,018 9/1982 Fratty ..... 362/350

*Primary Examiner*—Donald P. Walsh

*Attorney, Agent, or Firm*—Frishauf, Holtz, Goodman & Woodward

[57] ABSTRACT

To provide for essentially uniform illumination throughout the area, for example the film window of a film or slide projector, the reflector has at least two contours which form a reflector system, each contour being rotation-symmetrical with respect to the optical axis of the total system. The generatrices of the contours follow conical sections. The reflector is divided into zonal regions, with successive zonal regions lying on different contours. For example, two conical contours can be used, the contour of one conical section being such that spot illumination results, and the contour of the other conical section being such that a saddle-tight illumination is obtained so that the overall light output throughout the window is essentially uniform (see the additive of FIGS. 3*a* and 3*b*, as shown in FIG. 3*c*).

13 Claims, 6 Drawing Figures

REFLECTOR FOR UNIFORMLY ILLUMINATING AN AREA, PARTICULARLY A FILM WINDOW OF A FILM OR SLIDE PROJECTOR, AND REFLECTOR LAMP

CROSS REFERENCE TO RELATED APPLICATIONS

U.S. Ser. No. 275,150, filed June 19, 1981, Rakitsch and Bodmer, assigned to the assignee of the present application.

Reference to related U.S. Pat. Nos.: 4,021,659, 4,035,631, and to; German Patent Disclosure Document Nos.: DE-OS 21 48 478, to which U.S. Pat. No. 3,758,770 corresponds, DE-OS 23 63 378, to which U.S. Pat. No. 3,825,742 corresponds.

The present invention relates to a reflector structure which is used for illuminating an area, and more particularly for illuminating a film window for a film or slide projection system in which the film window is illuminated as uniformly as possible with the aid of the reflector.

BACKGROUND

With an areal light source, for instance a coiled filament and a smooth reflector surface, local brightness variations occur in the film window due to imaging of the filament. It has been proposed to roughen the reflector surface by knurling or facetting. A reflector having a surfce of numerous small reflective areas is described for instance in the U.S. Pat. Nos. 4,021,659 and 4,035,631. Other surface structures are described, among others, in German Disclosure Document Nos. DE-OS 21 48 478 and DE-OS 23 63 378 to which U.S. Pat. No. 3,758,770, Morasz and 3,825,742, Levin, correspond. The structures of the reflector surface described therein cause the beams to fan out or spread more than with a smooth reflector surface. Thus, the image of the filament structure in the film window is blurred, but a certain non-uniformity in the film window illumination remains nevertheless. As a result of the increased stray light, the utilized light flux falls. This has to be compensated by increasing the power input of the lamp; this, in turn, causes a higher temperature in the film window than with smooth reflector surfaces. The common feature of all these solutions is that the reflectors have one contour only.

THE INVENTION

It is an object to provide a reflector with a surface by which a good uniformity of the film window illumination may be obtained and stray light is avoided as far as possible.

Briefly, in accordance with the invention, the reflector for illuminating an area is characterized in that the reflector has at least two contours which are rotation-symmetrical with respect to the optical axis of the total system, their generatrices follow elliptical curves, i.e. sectional cuts through a cone, and the reflector is divided into zonal regions with successive regions lying on different contours. The focal points of the generatrices may coincide or may be displaced relatively to each other in the optical axis or on a parallel to the optical axis. Depending on the purpose the reflector is to serve, the contours may follow identical or non-identical elliptical curves. The parts forming the different contours must be present with a certain relative surface area. For example, when two contours A and B are used, the area proportions $F_A$ and $F_B$ of the total reflective area F should satisfy the equation $F_A = xF$ and $F_B = (1-x)\,F$, with $0.2 \leqq x \leqq 0.8$. Depending on the desired light distribution, the ratios of the areas of the different contours may be from between 1:4 and 1:1. The succession of the zones of different contours also depends on the application purpose. The reflector shall have at least two zonal regions which are rotation symmetrical with respect to the optical axis. The reflector area of a contour is formed by the rotation of a generatrix which follows the curve of a elliptical curve. The geometrical axis of at least one of the elliptical curves may be inclined relative to the optical axis, that is, include an angle with the optical axis of the total system.

By matching the different contours of the elliptical curves to one another, for instance such that the contour of one conical section yields a spot-type illumination and the contour of the other conical section yields a saddle-type illumination, a highly uniform illumination of the film window may be achieved.

With the reflector shapes of the invention which reflect the image of the luminous element by means of several reflector contours into the film window, the uniformity may be improved both in projection and in illumination. The decisive factor is that, in projection, the uniformity of the 1st order is improved over the entire projection screen and not only the uniformity of the 2nd order, i.e. small local variations in film window illumination as with the initially described reflectors which have numerous small reflective areas on one contour. To explain the above in more detail: the uniformity of the 1st order describes the shape of the illumination intensity across the projection screen, i.e. the basic shape of the curve; the uniformity of the 2nd order describes the slight variations in illumination intensity caused by images of lamp structures or other attendant phenomena in the film window arising within the basic illumination curve shape. An explanation for this improvement may be that a reflector whose contour corresponds to a single elliptical curve relationship can always primarily project only one object point into one image point. When, however, two contours are used, two object points may be projected into one image point or, conversely, on object point may be projected into two image points. When several contours are used, a corresponding number of associations of object point-/image point may be determined.

The contours may be distributed over the reflector in an arbitrary arrangement. It is important, however, that the overall length of the boundaries of the respective reflector contours should be as small as possible and the mold slants, e.g. for the blank manufacture, require only a small angle in space, with respect to the axis of the reflector.

DRAWINGS

Figures 3A, 3B, 3C:
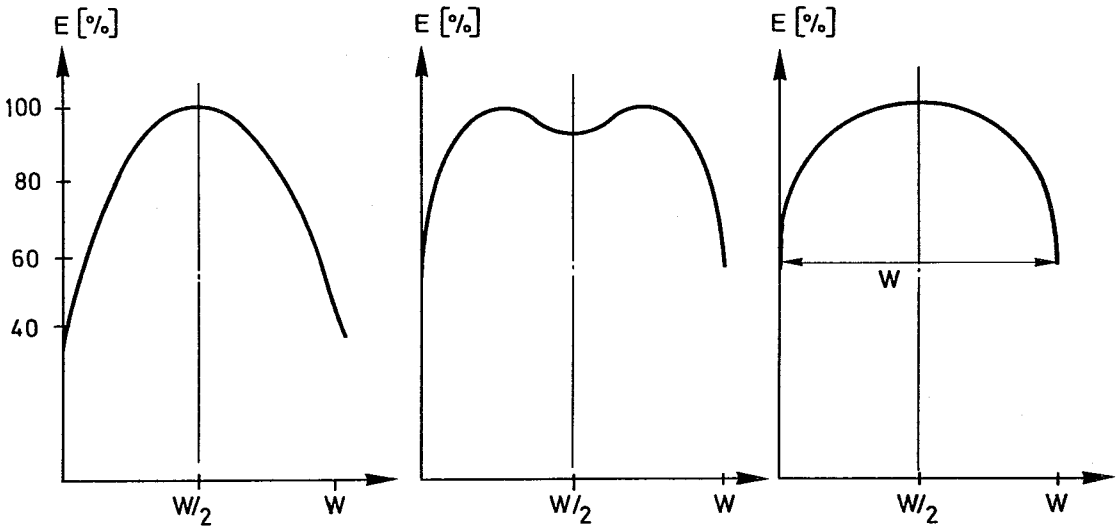
Figure 4:
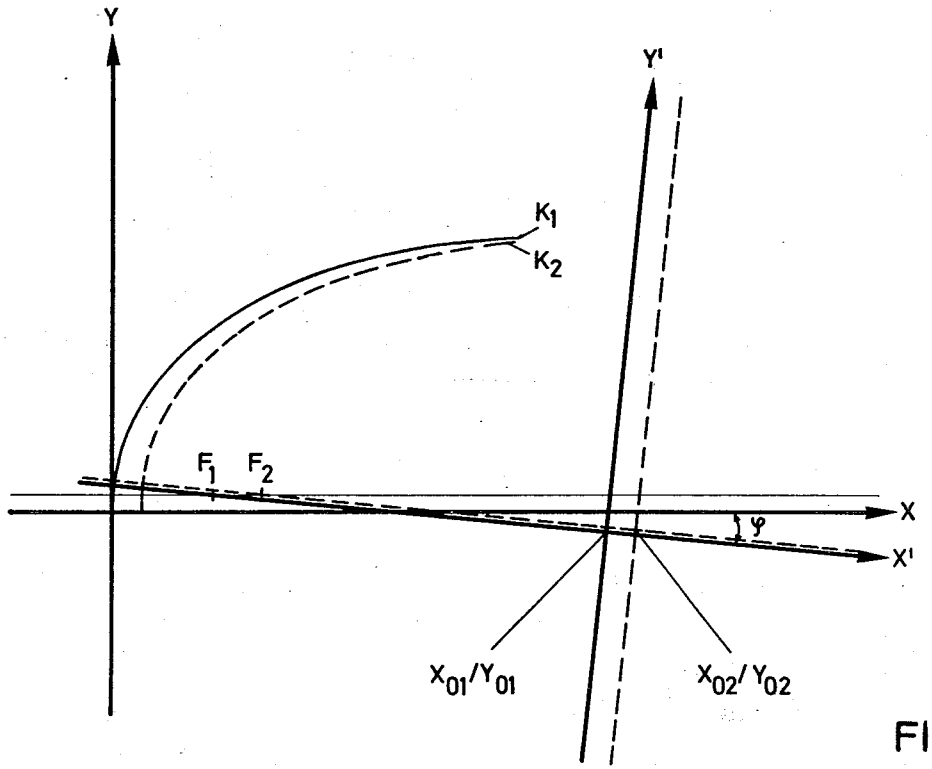

FIGS. 3*a* to 3*c* illustrate relative illumination intensity distributions;

FIG. 4 shows a diagram which illustrates schematically the position of the coordinate systems used for the elliptical curves.

Figure 2:
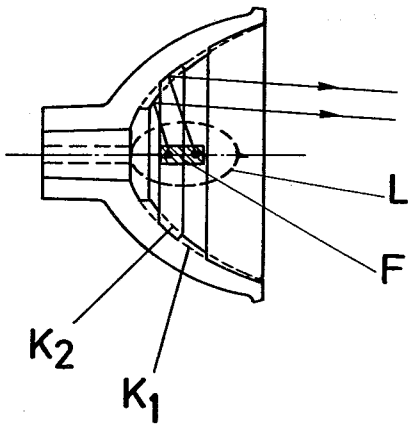
FIG. 2 shows a section through the reflector.
Figure 1:
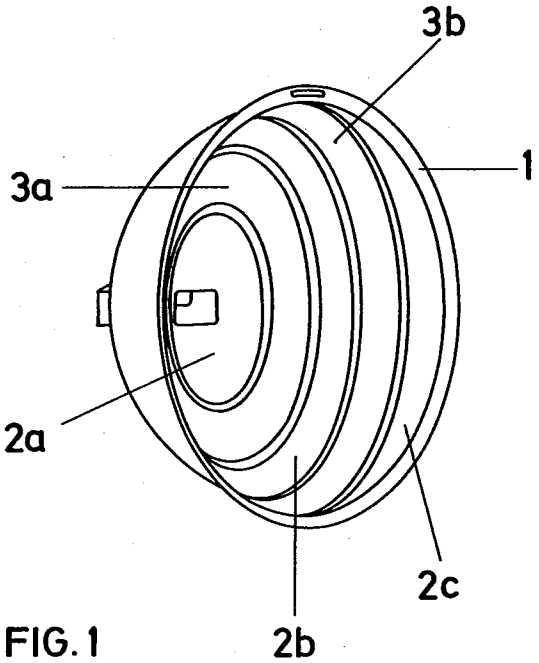
FIG. 1 shows a perspective top view of the reflector.

The reflector 1 in FIG. 1 is preferably made of borosilicate glass and is divided into five zones. The three zonal areas 2*a* to 2*c* have a contour $K_1$ (FIG. 2). The alternately arranged zonal areas 3*a* and 3*b* have a different contour $K_2$. The path of rays is illustrated in FIG. 2. FIG. 3*a* shows the illumination intensity distribution of contour 1 which yields a spot-type illumination. Here and in the following FIGS. 3*b* and 3*c*, W denotes the widest dimension of the area to be illuminated. FIG. 3*b* shows the illumination intensity distribution of contour 2 which yields a saddle-type illumination characteristic in the film window. In FIG. 3*c* is plotted the composite, improved illumination curve generated by the reflector which is composed of the two contour parts. In this example, the parts forming the different contours have a surface area ratio of 5:3 (area $K_1$ to area $K_2$). The widest dimension of the area to be illuminated, for example of a film window, is shown by the arrow W in FIG. 3*c*, from which the essential uniform illumination obtained throughout its dimension will be apparent.

In the diagram of FIG. 4, the two elliptical zones or contours are shown in their position to the optical axis of the total system. The coordinates $X_{01}$, $Y_{01}$ belong to the center of the inclined coordinate system X', Y' which is associated with the contour 1. Accordingly, the center of the coordinate system associated with the contour 2 is determined by $X_{02}$, $Y_{02}$. The coordinate system X', Y' is inclined relative to the coordinate system X, Y by the angle $\phi$, the X-axis being given by the optical axis of the total system. $F_1$ and $F_2$, respectively, designate the focal points of the two elliptical contours or curves.

The elliptical zones are placed in the form of bands, or strips (see FIG. 1) in the reflector, which is essentially cup-shaped.

Reflectors of this type having several contours are particularly suited for lamps with small luminous elements, large film windows and the use of only slightly opened ojectives. Good results are obtained, for instance, with the following exemplary embodiment: the reflector comprises two zonally arranged contours which follow identical elliptical curves. The reflector diameter is 50 mm. The equations for the contors 1 and 2 are: $X'^2/41.25^2+Y'^2/24.65^2=1$, with $X_{01}=41.24$ mm and $Y_{01}=-0.37$ mm (for contour $K_1$) and $X_{02}=43.54$ mm and $Y_{02}=-0.37$ mm (for contour $K_2$) and $\phi=1.42°$ (FIG. 4). The zone adjacent the apex is associated with the contour $K_1$. Its area is about 4% of the total reflector surface. A zone associated with the contour $K_2$ then follows, and has 10% of the reflector surface. This is followed alternately by zones of the contours $K_1$ of 16%, $K_2$ of 25% and again $K_1$ of 45% (see also FIGS. 1 and 2). The optical mounting distance is 35 mm, the film window has the dimensions 9.60 mm×7.0 mm (16 mm-projection), the image forming objective is 1:1.3/35. The lamp bulb used with, and for example sealed to, this reflector is a halogen cycle incandescent lamp of 24 V/250 W with a filament diameter of 2.6 mm and a filament length of 4.6 mm. The lamp bulb L is shown only schematically in FIG. 2, positioned with its filament F on the optical axis including the focal planes of the two contours.

I claim:

1. A reflector for illuminating an area, wherein the reflector is essentially cup-shaped and has at least two contours forming a reflector system;

each contour defines a circumferential band or strip rotation-symmetrical with respect to the optical axis of the total system; the generatrices of the said contours follow elliptical curves;

the reflector is divided into zonal regions;

successive zonal regions lie on different contours;

and the area proportions $F_A$ and $F_B$ of the contours A and B of the entire reflective area F satisfy the equations $F_A=x\ F$ and $F_B=(1-x)\ F$, with $0.2 \leqq x \leqq 0.8$.

2. A reflector as claimed in claim 1, wherein the focal points of the generatrices of the contours coincide.

3. A reflector as claimed in claim 1, wherein the focal points of the generatrices of the contours are displaced relatively to each other in the optical axis.

4. A reflector as claimed in claim 3, wherein the focal points of the generatrices of the contours are displaced relatively to each other on a parallel to the optical axis.

5. A reflector as claimed in claim 3, wherein the generatrices of the contours follow identical elliptical curves.

6. A reflector as claimed in claim 4, wherein the generatrices of the contours follow identical elliptical curves.

7. A reflector as claimed in claim 1, wherein the contours follow identical elliptical curves defined by the equations:

$$X'^2/41.25^2+Y'^2/24.65^2=1,$$

the focal points of the generatrices of the contours are displaced relative to each other and have coordinate points with respect to the apex of the reflector:

$X_{01}=41.24$ mm and $Y_{o1}=-0.37$ mm for one of the contours, and $X_{02}=43.54$ mm. and $Y_{02}=-0.37$ mm for the other contour;

and the coordinate system (X', Y') on which said contours are positioned is inclined with respect to the coordinate system (X, Y) including the optical axis (X) of the reflector by an angle $\phi$ in the order of 1.42°.

8. A reflector as claimed in claim 7, wherein the zone adjacent the apex is associated with the contour having the focal coordinates $X_{01}=41.24$ mm and $Y_{01}=-0.37$ mm.

9. A reflector as claimed in claim 8, wherein the area of the contour closest to the apex is about 4% of the overall reflector surface, the next subsequent zone having the other contour or curve has about 10% of the reflector surface, and then, alternatingly, the respective contours or zones will have reflector surfaces: 16%, 25%, 45%.

10. A reflector as claimed in claim 1, wherein the geometrical axis of at least one of the elliptical curves includes an angle with the optical axis of the total system.

11. A reflector as claimed in claim 1, wherein the reflector comprises at least two zonal regions.

12. A reflector as claimed in claim 1, wherein two contours are used, the contour of one of the elliptical curves being such that a spot-type illumination results, and the contour of the other elliptical curve being such that a saddle-type illumination is obtained.

13. A reflector-lamp combination comprising a halogen cycle incandescent bulb, and a reflector as claimed in claim 1 secured to said bulb.

* * * * *